US007101186B1

(12) United States Patent
Hughes

(10) Patent No.: US 7,101,186 B1
(45) Date of Patent: Sep. 5, 2006

(54) DALLY PRACTICING SYSTEMS

(76) Inventor: Gabriel T. Hughes, P.O. Box 852, Avondale, AZ (US) 85323

( * ) Notice: Subject to any disclaimer, the term of this patent is extended or adjusted under 35 U.S.C. 154(b) by 0 days.

(21) Appl. No.: 10/813,738

(22) Filed: Mar. 30, 2004

Related U.S. Application Data

(60) Provisional application No. 60/459,434, filed on Mar. 31, 2003, provisional application No. 60/492,890, filed on Aug. 6, 2003.

(51) Int. Cl.
*A63B 69/04* (2006.01)

(52) U.S. Cl. ..... 434/247; 434/225

(58) Field of Classification Search ..... 119/794, 119/795, 796, 797, 798, 839, 805, 789; 434/247, 434/225; 273/338, 336, 337, 339
See application file for complete search history.

(56) References Cited

U.S. PATENT DOCUMENTS 2,217,323 A * 10/1940 Sackett ..... 242/379.2
2,314,504 A * 3/1943 Lifchultz ..... 242/379.2
2,563,533 A * 8/1951 Knox ..... 119/805
2,776,644 A * 1/1957 Fontaine ..... 119/796
2,821,960 A * 2/1958 Rudolph ..... 119/712
3,123,052 A * 3/1964 Marshall ..... 119/789
3,853,283 A * 12/1974 Croce et al. ..... 242/381.6
4,353,546 A * 10/1982 Rhoades ..... 482/94
4,470,373 A * 9/1984 Kesler ..... 119/427
5,377,626 A * 1/1995 Kilsby et al. ..... 119/796
6,000,989 A * 12/1999 Bacque ..... 446/236
6,763,650 B1 * 7/2004 Snow ..... 54/71

* cited by examiner

*Primary Examiner*—Dmitry Suhol
(74) *Attorney, Agent, or Firm*—Stoneman Law Offices, Ltd.; Martin L. Stoneman; Benjamin K. Erlick

(57) ABSTRACT

A dally practicing system which simulates the conditions of roping a steer with relative safety. The portable dallying practice system takes up slack in a rope without applying excessive tension which could injure the user, provides a clutch system which allows for convenient manipulation of the tension, and provides a safety release mechanism which automatically releases the tension if the tension becomes excessive.

21 Claims, 7 Drawing Sheets

DALLY PRACTICING SYSTEMS

CROSS-REFERENCE TO RELATED APPLICATION

The present application is related to prior provisional application Ser. No. 60/459,434, filed Mar. 31, 2003, entitled "DALLY PRACTICING SYSTEM", and, prior provisional application Ser. No. 60/492,890, filed Aug. 6, 2003, entitled "DALLY PRACTICING SYSTEM" from both of which priority is claimed, and the contents of which are incorporated herein by these references and are not admitted to be prior art with respect to the present invention by the mention in this cross-reference section.

BACKGROUND

This invention relates to providing systems for assisting a user in practicing dallying. Dallying is the act of wrapping a rope around the horn of a saddle. Dallying is one of the fundamental skills involved in roping which many cowboys and cowgirls need to practice for roping competition in tournaments, rodeos, etc. It is important for such cowboys and cowgirls to achieve a high level of skill at dallying. Speed and proper technique can give a competitive advantage and improper dallying can result in serious injuries. For example, team roping is a timed contest in a rodeo that features two cowpersons competing together: a "header" and a "heeler". The header ropes the steer's head, dallies (wraps the end of the rope around the saddle horn) and pulls the steer with the rope. The heeler then ropes the back legs of the steer, dallies, and stops his horse. When the heeler catches and dallies and both ropes are tight, the header stops and turns his horse to face the heeler, and the clock is stopped. The team with the fastest time wins the competition.

It is especially important for the heeler to dally soon after roping the steer for at least two reasons: 1) to stop the steer from pulling the rope out of the heeler's hands; and 2) to complete the run and stop the clock as fast as possible. The force the steer exerts on the rope can make dallying difficult. The heeler must judge the slack in the rope and how quickly the slack is being taken up. The heeler must also judge whether and how much rope to let slip to create more slack, if necessary.

The heeler's/dallyer's fingers can be smashed or even ripped off by the tension in the rope if dallying is not accomplished properly. For these reasons it is important to practice the technique of dallying—and to practice it safely.

OBJECTS AND FEATURES OF THE INVENTION

A primary object and feature of the present invention is to provide dally practicing systems. A further object and feature of the present invention is to provide a system that assists a user in practicing dallying.

It is a further object and feature of the present invention to provide such a system that is relatively safe. It is a further object and feature of the present invention to provide such a system that has a safety release.

It is yet a further object and feature of the present invention to provide such a system a tensioner for retracting a dally training line. It is a further object and feature of the present invention to provide such a system having adjustable tension. It is yet a further object and feature of the present invention to provide such a system having irregular and/or eccentric tension. It is yet a further object and feature of the present invention to provide such a system having a tensioner attachable to a fixed object.

It is a further object and feature of the present invention to provide such a system that comprises a safe method of dallying training. It is a further object and feature of the present invention to provide such a system that simulates the conditions of competition to provide more valuable training.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a dally training system, for use by a dallyer, for safe dally-practicing, near a substantially fixed object, using at least one saddle horn and using at least one dally rope, comprising, in combination: line means for providing at least one selectably retractable line; tension means for controllably applying at least one tension force to such line for selectably retracting such line means; and at least one such dally rope. Moreover, it provides such a dally training system wherein line means comprises such at least one such dally rope. Additionally, it provides such a dally training system further comprising first connection means for connecting such line means to such at least one such dally rope. Also, it provides such a dally training system further comprising second connection means for connecting such tension means to the fixed object. In addition, it provides such a dally training system further comprising second connection means for connecting such tension means to the fixed object. And, it provides such a dally training system further comprising saddle horn means fixable in adjacent position to such dallyer when such dallyer is using such line means in such dally-practicing.

In accordance with another preferred embodiment hereof, this invention provides a dally training system for safe user-practicing, near a substantially fixed object, using at least one user's rope, the dallying steps to be used by a user, comprising, in combination: line means for providing at least one retractable line; tension means for applying at least one tension force to such line for retracting such line means; and saddle horn means for dallying substantially adjacent to such dallyer when such dallyer is using such line means in such dally-practicing. Further, it provides such a dally training system wherein line means comprises such at least one such dally rope. Even further, it provides such a dally training system further comprising first connection means for connecting such line means to such at least one such dally rope. Moreover, it provides such a dally training system further comprising second connection means for connecting such tension means to the fixed object. Additionally, it provides such a dally training system further comprising second connection means for connecting such tension means to the fixed object.

In accordance with a preferred embodiment hereof, this invention provides a dally training system, relating to use by a dallyer, for safe dally-practicing, near a substantially fixed object, using at least one saddle horn and using at least one dally rope, comprising, in combination: line means for providing at least one selectably retractable line; tension means for controllably applying at least one tension force to such line for selectably retracting such line means; and such at least one dally rope. Moreover, it provides such a dally training system, wherein such line means comprises such at least one dally rope. Additionally, it provides such a dally training system, further comprising first connection means for connecting such line means to such at least one dally rope. Also, it provides such a dally training system, further comprising second connection means for connecting such tension means to the substantially fixed object. In addition, it provides such a dally training system, further comprising second connection means for connecting such tension means to the substantially fixed object. And, it provides such a dally training system further comprising saddle horn means for holding such line means fixable in adjacent position to such dallyer when such dallyer is using such line means in such dally-practicing.

In accordance with another preferred embodiment hereof, this invention provides a dally training system, relating to use by a dallyer, for safe dally-practicing, near a substantially fixed object, using at least one saddle horn and using at least one dally rope, comprising, in combination: at least one line structured and arranged to provide at least one selectably retractable line; at least one tensioner structured and arranged to controllably apply at least one tension force to such at least one line; and selectably retract such at least one line; and such at least one dally rope. Further, it provides such a dally training system, wherein such at least one line comprises such at least one dally rope. Even further, it provides such a dally training system, further comprising at least one first connector adapted to connect such at least one line to such at least one dally rope. Moreover, it provides such a dally training system, further comprising at least one second connector adapted to connect such at least one tensioner to the fixed object. Additionally, it provides such a dally training system, further comprising at least one second connector adapted to connect such at least one tensioner to the fixed object. Also, it provides such a dally training system further comprising at least one saddle horn to hold such at least one line fixable in adjacent position to such dallyer when such dallyer is using such at least one line in such dally-practicing.

In accordance with another preferred embodiment hereof, this invention provides a dally training system, relating to safe dally-practicing, near a substantially fixed object, using at least one dallyer's rope, the dallying steps to be used by a dallyer, comprising, in combination: providing at least one line; applying at least one tension force to such at least one line for retracting such at least one line; connecting such at least one tension force to the substantially fixed object; connecting such at least one line to such at least one dallyer's rope; and dallying substantially adjacent to such dallyer when such dallyer is using such at least one line in such dally-practicing.

In accordance with another preferred embodiment hereof, this invention provides a dally training system, relating to use by a dallyer, for safe dally-practicing the steps of dallying, near a fixed object, using at least one saddle horn and using at least one dally rope, comprising, in combination: at least one line; at least one tensioner adapted to apply at least one tension force to such at least one line such that such at least one line is retractable; and at least one saddle horn to hold such at least one line substantially adjacent to such dallyer when such dallyer is using such at least one line in such dally-practicing. In addition, it provides such a dally training system, wherein such at least one line comprises such at least one dally rope. And, it provides such a dally training system, further comprising at least one first connector to connect such at least one line to such at least one dally rope. Further, it provides such a dally training system, further comprising at least one second connector to connect such at least one tensioner to the fixed object. Even further, it provides such a dally training system, further comprising at least one second connector to connect such tensioner to the fixed object. Moreover, it provides such a dally training system, further comprising at least one saddle horn to hold such at least one line fixable in adjacent position to such dallyer when such dallyer is using such at least one line in such dally-practicing.

Additionally, it provides such a dally training system, further comprising at least one reel. Also, it provides such a dally training system, wherein such at least one tensioner comprises at least one spring. In addition, it provides such a dally training system, wherein such at least one tensioner comprises at least one clutch system structured and arranged to allow the dallyer to selectably control tension in such at least one line. And, it provides such a dally training system, wherein such at least one line comprises at least one safety release. Further, it provides such a dally training system, wherein such at least one safety release comprises at least one hook and loop material. Even further, it provides such a dally training system, further comprising at least one anti-kinking element structured and arranged to assist anti-kinking in such at least one line. The dally training system, wherein such at least one anti-kinking element comprises at least one swivel.

In accordance with another preferred embodiment hereof, this invention provides a dally training system, relating to use by a dallyer, for safe dally-practicing, near a fixed object, using at least one saddle horn and using at least one dally rope, comprising, in combination: at least one line; and at least one tensioner adapted to apply at least one tension force to such at least one line such that such at least one line is retractable; wherein such at least one tensioner comprises at least one reel adapted to wind and unwind such at least one line. Even further, it provides such a dally training system wherein such at least one reel comprises at least one eccentric portion adapted to provide irregular retraction of such at least one line. Even further, it provides such a dally training system wherein such at least one eccentric portion comprises at least one protrusion. Even further, it provides such a dally training system wherein such at least one eccentric portion comprises exactly one protrusion. Even further, it provides such a dally training system further comprising at least one dally rope.

Even further, it provides such a training system, further comprising at least one anti-kinking element structured and arranged to assist anti-kinking in such at least one line. Even further, it provides such a dally training system, wherein such at least one anti-kinking element comprises at least one swivel. Even further, it provides such a dally training system further comprising at least one safety release.

DETAILED DESCRIPTION OF THE BEST MODES AND PREFERRED EMBODIMENTS OF THE INVENTION

Figure 1A:
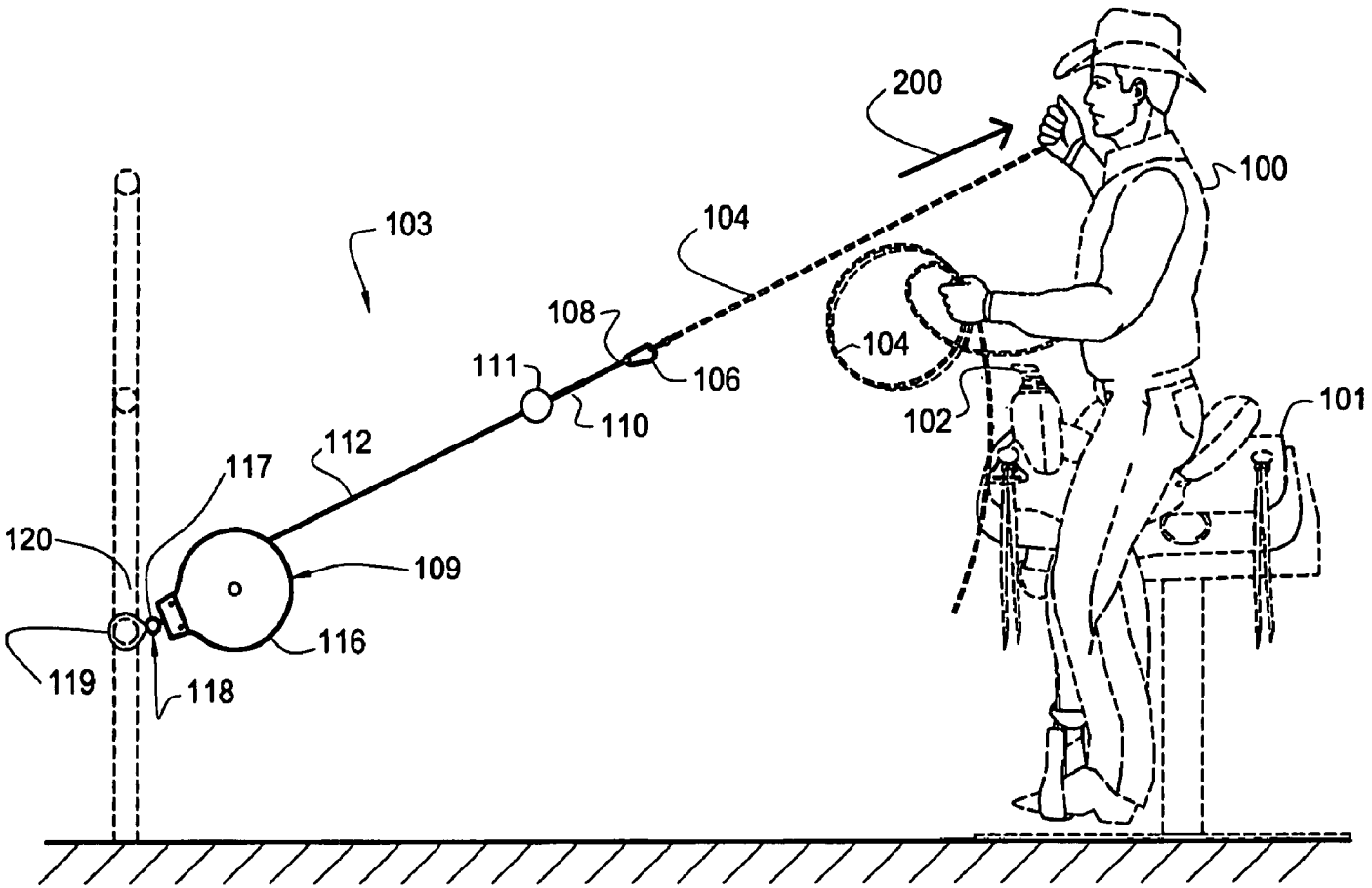
FIG. 1A shows a side view of a dally practicing system, according to a preferred embodiment of the present invention, attached to a fixed object, e.g., a fence post, showing a user pulling on the rope.

FIG. 1A shows a side view of a dally practicing system 103, according to a preferred embodiment of the present invention, attached to a fixed object 120 (such as, for example, a fence post, as shown).

Figure 1B:
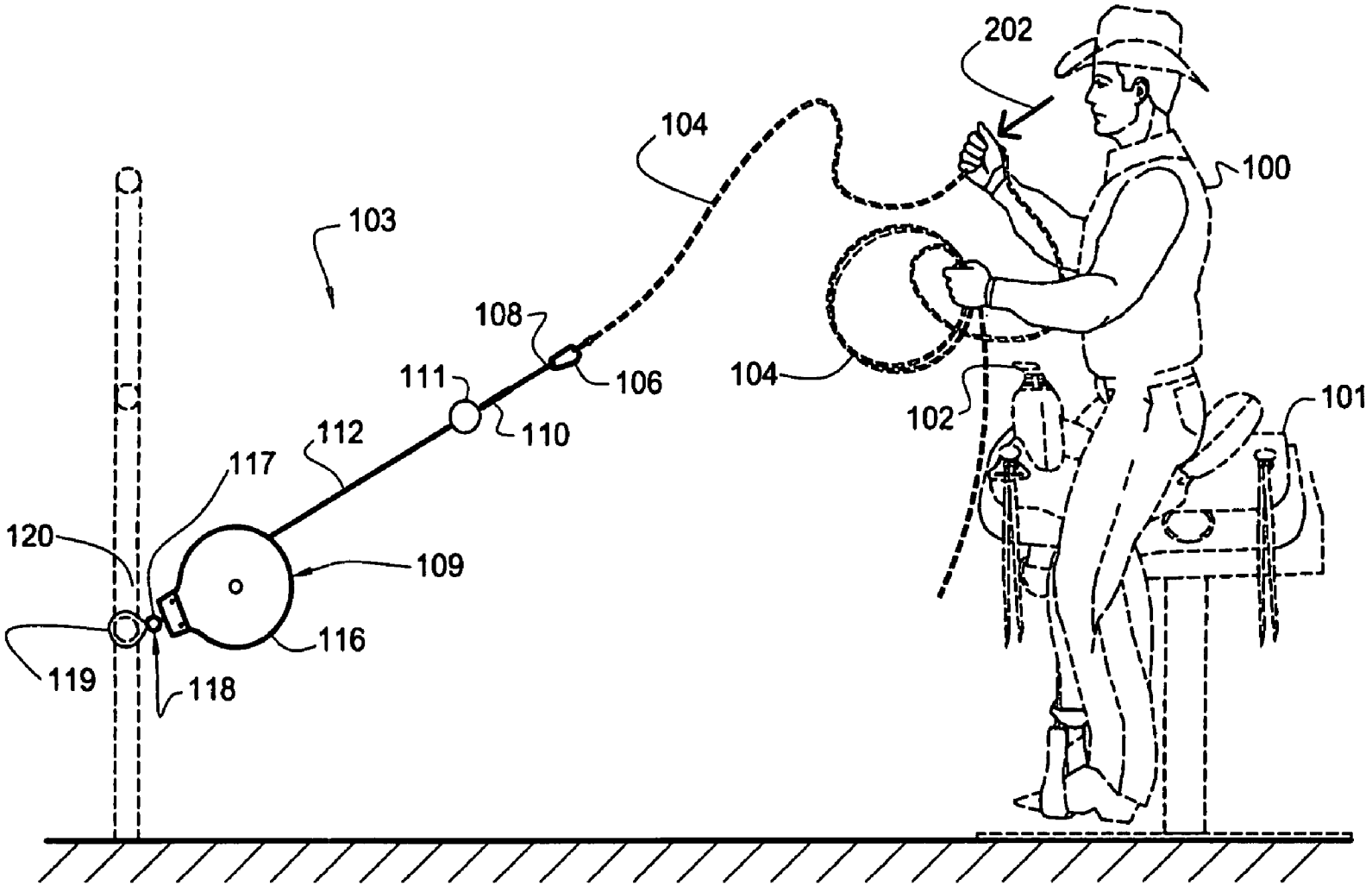
FIG. 1B shows a side view of the dally practicing system of FIG. 1A, showing a user creating slack in the rope.

FIG. 1B shows a side view of the dally practicing system 103 of FIG. 1A, showing a user creating slack in the rope 104.

Figure 1C:
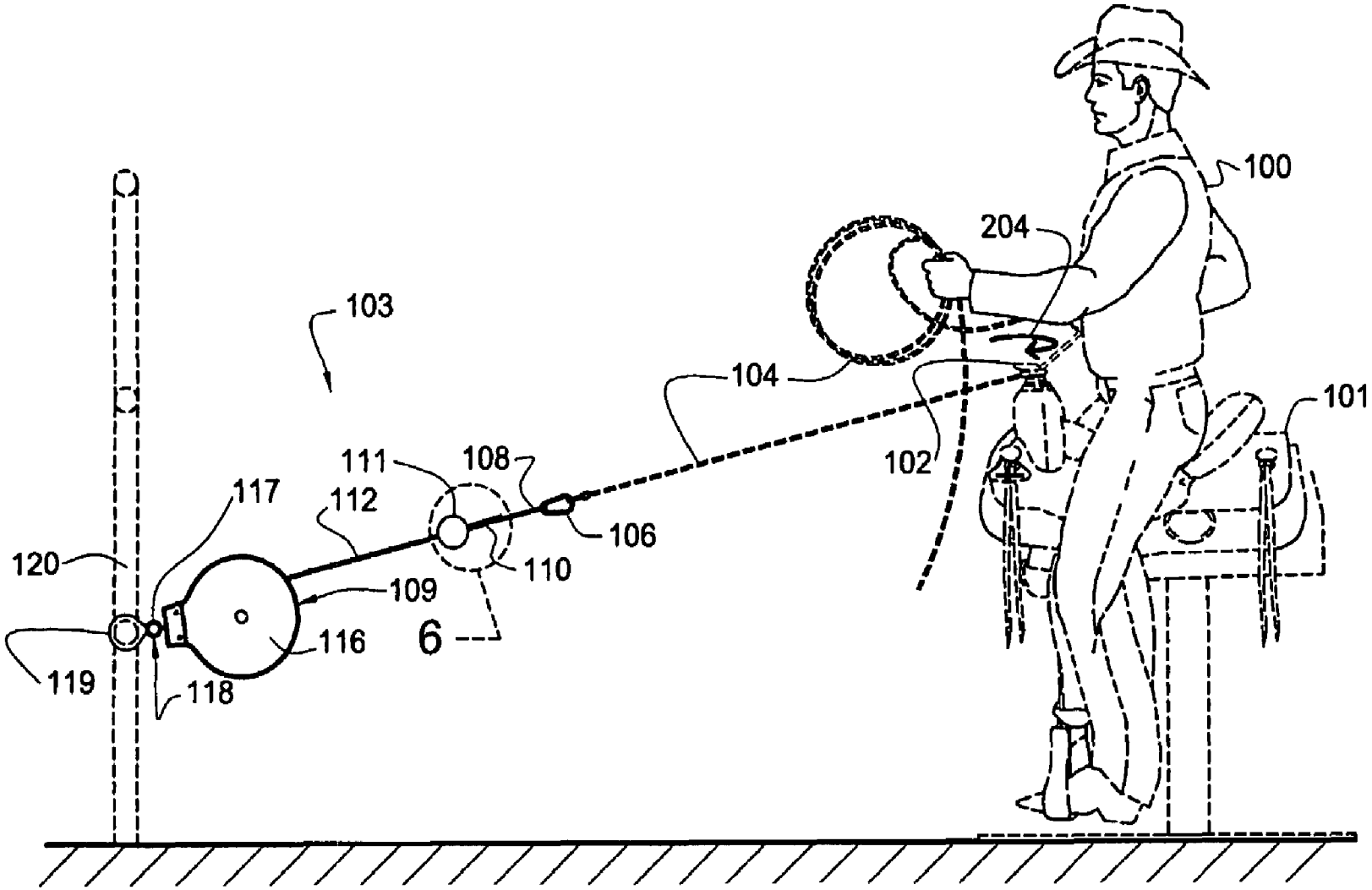
FIG. 1C shows a side view of the dally practicing system of FIG. 1A, showing a user that has dallied the rope around a saddle horn.

FIG. 1C shows a side view of the dally practicing system 103 of FIG. 1A, showing a user that has dallied the rope 104 around a saddle horn 102.

When a cowboy practices dallying with a steer on the distal end of the rope, the conditions (and dangers) of dallying are both present. The cowboy could get injured or lose a finger if movement of the steer quickly takes up the slack in the rope and the cowboy's hand gets caught in the rope. Therefore, it would be desirable to provide conditions that simulate having a steer on the distal end of the rope while providing safer conditions for developing the skill of dallying. This is especially important for people just beginning to learn the skill of dallying. In the past, to be safe, people have practiced dallying by tying the distal end of the rope around a fixed object. In this case, there is always slack in the rope, since the fixed object does not move to take up the slack. However, an important part of developing the skill of dallying is gauging the slack in the rope that gets taken up as the steer moves. An important component of the skill involved in dallying is being able to dally while the slack is being taken up.

FIG. 1A through FIG. 1C shows the dally practicing system 103 being used by user 100 sitting on saddle 101. Preferably, saddle 101 may be in a fixed position, as shown (such as, for example, as shown, mounted on a post fixed to a stand, or fixed in the ground) or may be mounted on a horse, etc. Upon reading this specification, those of skill in the art will now understand that, under appropriate circumstances, considering issues such as convenience, user preference, cost, etc., other configurations may suffice, such as, for example, having saddle 101 mounted on a mobile device, or a configuration comprising only a portion of a saddle 101 with a saddle horn 102, etc.

Figure 2:
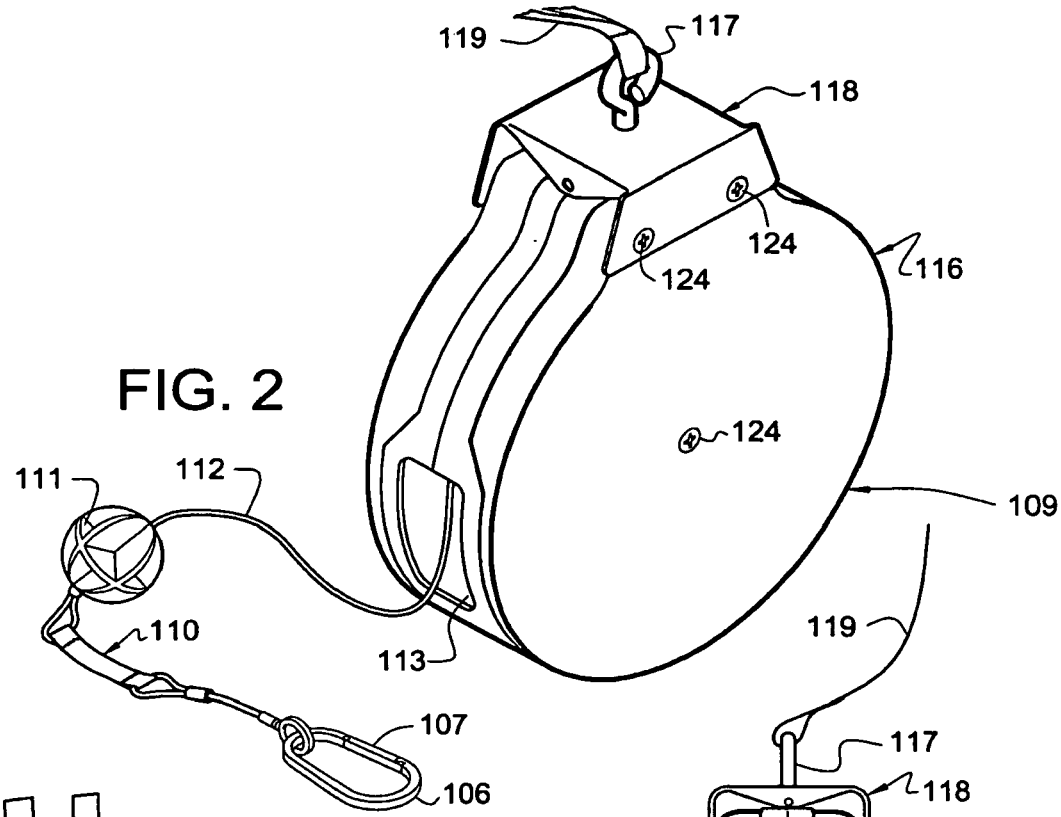
FIG. 2 shows a perspective view of the dally retractor according to FIG. 1A.

FIG. 2 shows a perspective view of the dally retractor 109 of FIG. 1A.

Figure 3:
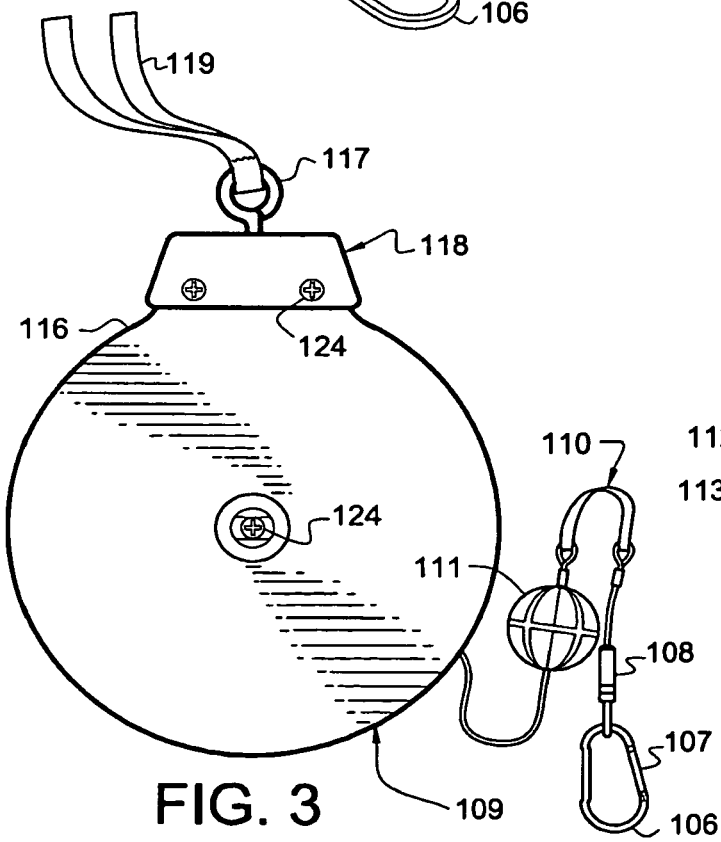
FIG. 3 shows a side view of the dally retractor according to FIG. 2.

FIG. 3 shows a side view of the dally retractor 109 according to FIG. 2.

Figure 4:
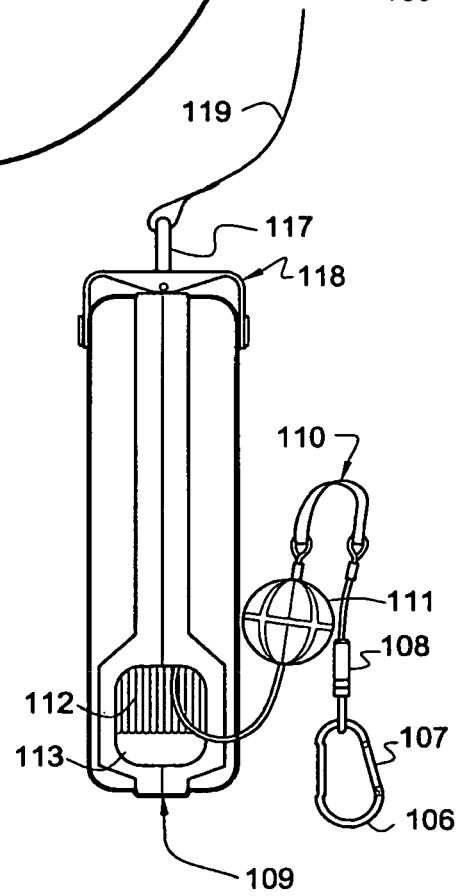
FIG. 4 shows a front view of the dally retractor according to FIG. 2.

FIG. 4 shows a front view of the dally retractor 109 according to FIG. 2. Preferably, rope 104 (embodying herein at least one such dally rope) is connected to line 112 by connector 106 (embodying herein first connection means for connecting said line means to said at least one such dally rope), as shown.

Preferably, connector 106 comprises swivel 108 that helps prevent rope 104 from kinking (embodying herein anti-kinking means for helping prevent kinking in such at least one dally rope). Preferably, connector 106 comprises a quick release mechanism 107 which permits user 100 to easily and conveniently attach and detach rope 104 from line 112, as shown, so that, for example, rope 104 can be replaced when it is worn or damaged and so user can switch out different styles of ropes. Preferably, connector 106 comprises swivel 108, (best shown in FIG. 9). Preferably, connector 106 and swivel 108 are made of metal, preferably steel, for strength and durability. According to an alternate preferred embodiment, connector 106 comprises a carabiner. Upon reading this specification, those skilled in the art will now understand that, under appropriate circumstances, considering issues such as strength, production cost, convenience, etc., other types of connectors may suffice, such as, for example, tying rope 104 to a loop of line 112, etc. Preferably, line 112 is made of metal, preferably steel cable, preferably coated in a protective, clear, plastic sleeve or coating. Upon reading this specification, those skilled in the art will now understand that, under appropriate circumstances, considering issues such as strength, durability, friction, production cost, etc., it may suffice for line 112 to be made of material other than metal, such as, for example, nylon, to reduce cost, etc. Upon reading this specification, those skilled in the art will now understand that, under appropriate circumstances, considering issues such as market demand, cost, reel mechanism, etc., it may suffice for line 112 to be made of rope, in which case, for example, it may suffice to omit connector 106, etc.

Figure 7:
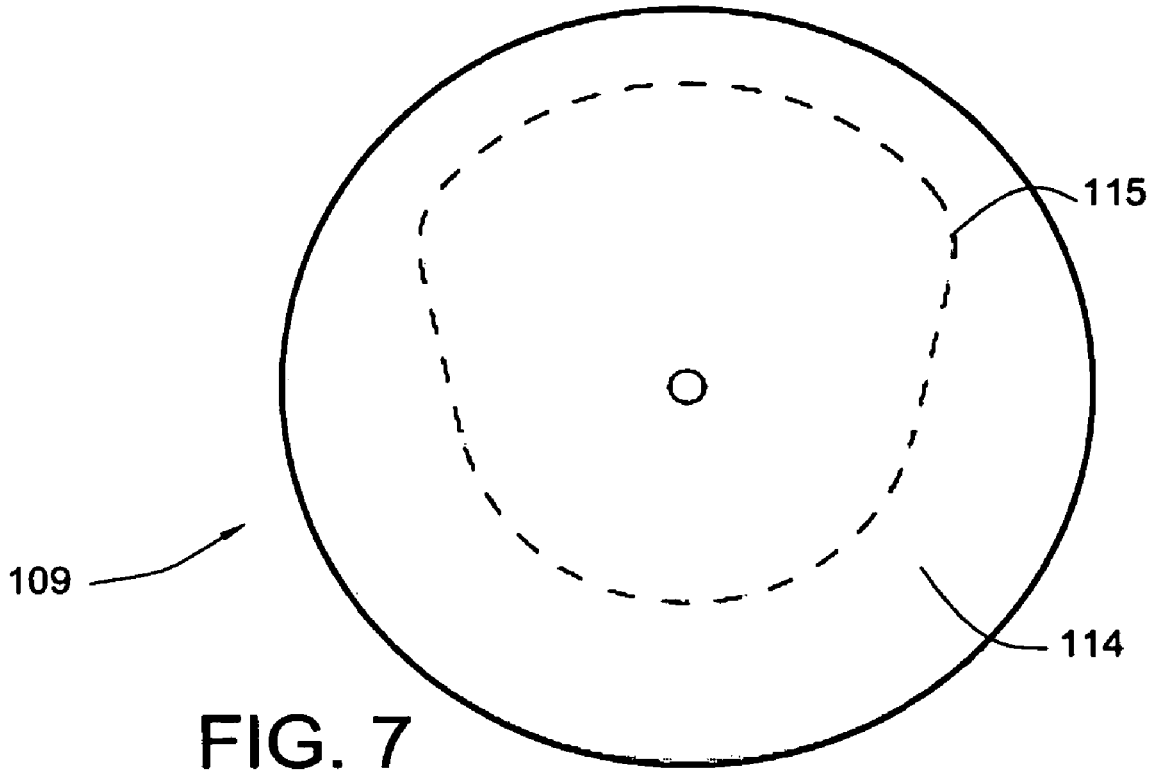
FIG. 7 shows a side view, partially in section, of the dally retractor reel according to FIG. 5 illustrating a preferred asymmetric protrusion.
Figure 8:
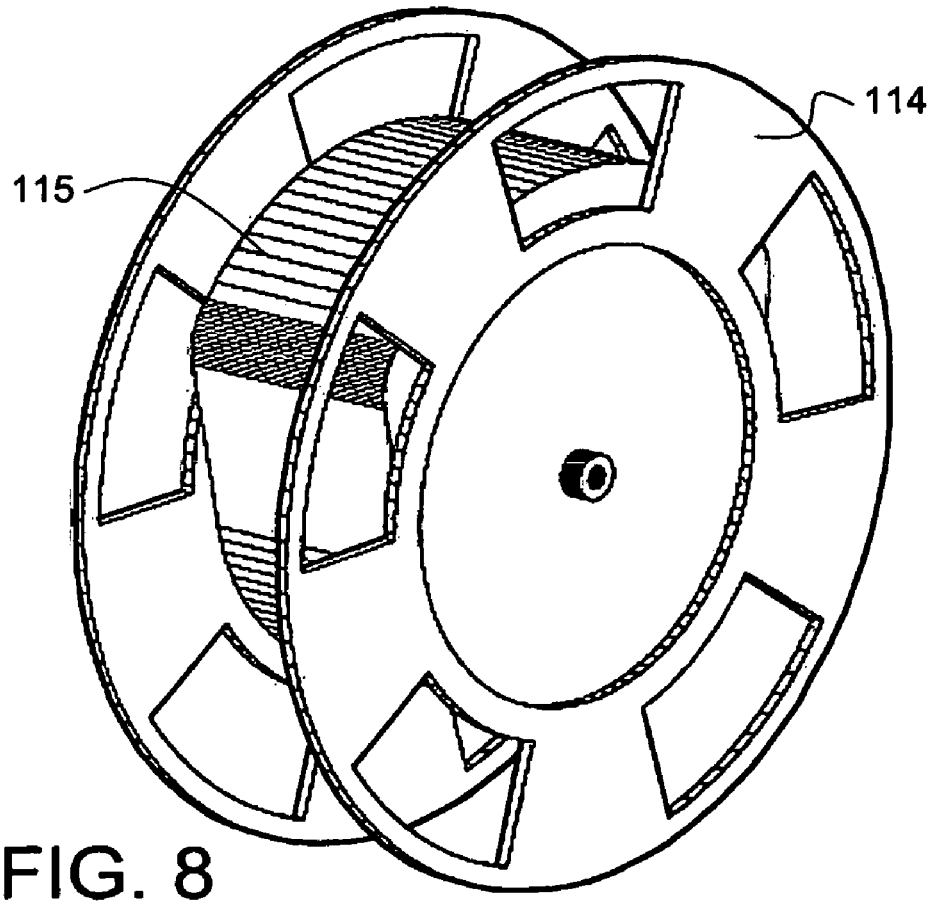
FIG. 8 shows a perspective view of the dally retractor reel according to FIG. 7.

Preferably, line 112 is coiled around reel 114, which is enclosed by case 116, as shown. Preferably, reel 114 comprises an asymmetric protrusion 115 (such as, for example, as shown in FIG. 7 and FIG. 8) so that reel 114 is eccentric and the speed with which slack is taken up and/or the tension in line 112 varies as the line is coiled around reel 114, thereby assisting in the simulation of an animal on the end of a rope (embodying herein wherein said reel means comprises eccentric means for providing irregular retraction of said line means for improved simulation of the movement of an animal; and embodying herein wherein said eccentric means comprises at least one protrusion; and embodying herein wherein said eccentric means comprises exactly one protrusion; and embodying herein wherein said at least one reel comprises at least one eccentric portion adapted to provide irregular retraction of said at least one retractable line). Preferably, reel 114 is structured and arranged so that reel 114 will coil the cable up in such a way as to simulate the pull of a running steer. Upon reading this specification, those skilled in the art will now understand that, under appropriate circumstances, considering issues such as user preference, production cost, etc., other reel arrangements may suffice, such as, for example, omitting eccentric protrusion (normal symmetrical reel), other protrusion arrangements (such as more than one, different shapes, etc.), etc.

Preferably, line 112 comprises a stopper 111 that prevents the end of line 112 from being pulled inside of case 116, as shown. Preferably stopper 111 is sized larger than the opening 113 (which line 112 passes through) in case 116. Preferably, stopper 111 is made of hard rubber so that it may absorb and dampen the impact of colliding with objects such as case 116 during operation. Preferably, stopper 111 is attached to line 112, preferably located, as shown, so as to prevent safety release 110, swivel 108 or connector 106 from entering case 116. Upon reading this specification, those skilled in the art will now understand that, under appropriate circumstances, considering issues such as production cost, market demand, circumstances of intended use, etc., it may suffice to omit case 116; in such circumstance, for example, attaching system 118 would be modified to allow user 100 to attach reel 114 to a fixed object 120, etc.

Preferably, case 116 comprises attaching system 118 for attaching case 116 to a fixed object 120, as shown. Preferably, attaching system 118 allows user 100 to quickly and conveniently attach case 116 to fixed object 120. Upon reading this specification, those skilled in the art will now understand that, under appropriate circumstances, considering issues such as location, and types of objects available, etc., it may suffice to attach case 116 to an object that is not fixed, such as, for example, a heavy object on wheels, etc.

Preferably, attaching system 118 (embodying herein second connection means for connecting said tension means to the fixed object) comprises a metal ring 117 that swivels, as shown, through which a strap 119 is threaded and tied to fixed object 120. Upon reading this specification, those skilled in the art will now understand that, under appropriate circumstances, considering issues such as production cost, market demand, types of objects to which users want to attach such dallying system, etc., other attaching systems may suffice, such as, for example, clamps, carabiners, short cables, chains, etc., may suffice.

In a preferred embodiment of the present invention, line 112 comprises safety release 110 that allows rope 104 to detach from line 112, as shown. Preferably, safety release 110 is automatically released when tension in line 112 exceeds a predetermined value, so that user 100 will not be injured (for example, if the user's fingers are caught in the rope). Preferably safety release 110 is made of strips of hook and loop fabric such as, for example, Velcro™ (see FIG. 6). Upon reading this specification, those skilled in the art will now understand that, under appropriate circumstances, considering issues such as cost, reliability, consumer demand, etc., other safety release arrangements may suffice, such as for example, reinforcing the hook and loop fabric with nylon webbing, using release mechanisms other than hook and loop fabric (such as, for example snaps), a clutch that releases tension on line 112, etc.

Preferably, reel 114 has a retraction mechanism 122 that places tension on line 112 (which places tension on rope 104) and acts to retract line 112 (embodying herein line means for providing at least one retractable line) into case 116. Preferably, retraction mechanism 122 comprises spring 123, preferably a power spring, (see FIG. 5). Upon reading this specification, those skilled in the art will now understand that, under appropriate circumstances, considering issues such as cost, reliability, consumer demand, etc., retraction mechanisms other than spring 123 such as, for example, a motor, etc., may suffice.

Preferably, retraction mechanism 122 exerts between about ten to about forty pounds of tension pulling line 112, preferably enough to simulate a steer taking up slack in the line 112, while remaining relatively safe (preferably not enough to cut-off a finger caught in the line 112 or rope 104, for example). Upon reading this specification, those of ordinary skill in the art will now understand that, under appropriate circumstances, such as user preference, advances in technology, strength of the dallier, etc., other tension modifiers, such as adjustable tension, very light tension, variable tension, etc., may suffice.

Preferably, retraction mechanism 122 takes up slack in rope 104 at a rate between about four feet per second to about twelve feet per second, more preferably about eight feet per second. Preferably retraction mechanism 122 (embodying herein tension means for controllably applying at least one tension force to said line for selectably retracting said line means) comprises a clutch system 121 (see FIG. 5) that assists a user 100 to stop the tension placed on line 112 (embodying herein line means for providing at least one selectably retractable line). Upon reading this specification, those of ordinary skill in the art will now understand that, under appropriate circumstances, such as user preference, advances in technology, intended use, etc., other retraction mechanism actions, such as changing tension over time, releasing tension at a set point, etc., may suffice.

Preferably, in operation, a user 100 (also herein called a dallyer) practices dallying by wrapping rope 104 around the saddle horn 102 (embodying herein saddle horn means fixable in adjacent position to such dallyer when such dallyer is using said line means in such dally-practicing) of saddle 101, as shown in FIG. 1C. Preferably, retraction mechanism 122 takes up slack in rope 104, simulating a steer and providing a more realistic training experience. Preferably, reel 116 allows at least fifteen feet of cable to be released/retracted. Preferably, user 100 begins by releasing a length of line 112 from reel 116, such as, for example fifteen feet. The user then preferably coils a similar amount of rope 104 in one hand, as shown in FIG. 1A. Preferably, user 100 can control whether retraction mechanism 122 provides tension in the line or not by engaging and disengaging clutch system 121. Preferably clutch system 121 operates by engaging when line 112 is slowly retracted, stopping retraction mechanism 122 from placing tension on line 112. Preferably, clutch system 121 is disengaged when line 112 is pulled from reel 116 (releasing line 112, and allowing retraction mechanism 122 to place tension on line 112). Preferably, user 100 practices dallying by getting positioned with coiled rope 105 in one hand and then pulling 200 (as shown especially in FIG. 1A) on rope 104 with the other hand (thereby releasing clutch system 121, if engaged), as shown in FIG. 1A. Preferably, user 100 then creates slack in rope 104 by moving the hand quickly forward 202 (as shown in FIG. 1B) and dallies 204 (as shown in FIG. 1C) while retraction mechanism 122 takes up the slack. Preferably, user 100 can create extra slack in line 112 by releasing coiled rope 105. Upon reading the teachings of this specification, those with ordinary skill in the art will now understand that, under appropriate circumstances, considering such issues as economics, user preference, teaching method, dallyer age and height, etc., other dally practice methods with dally practicing system 103 may suffice.

Figure 5:
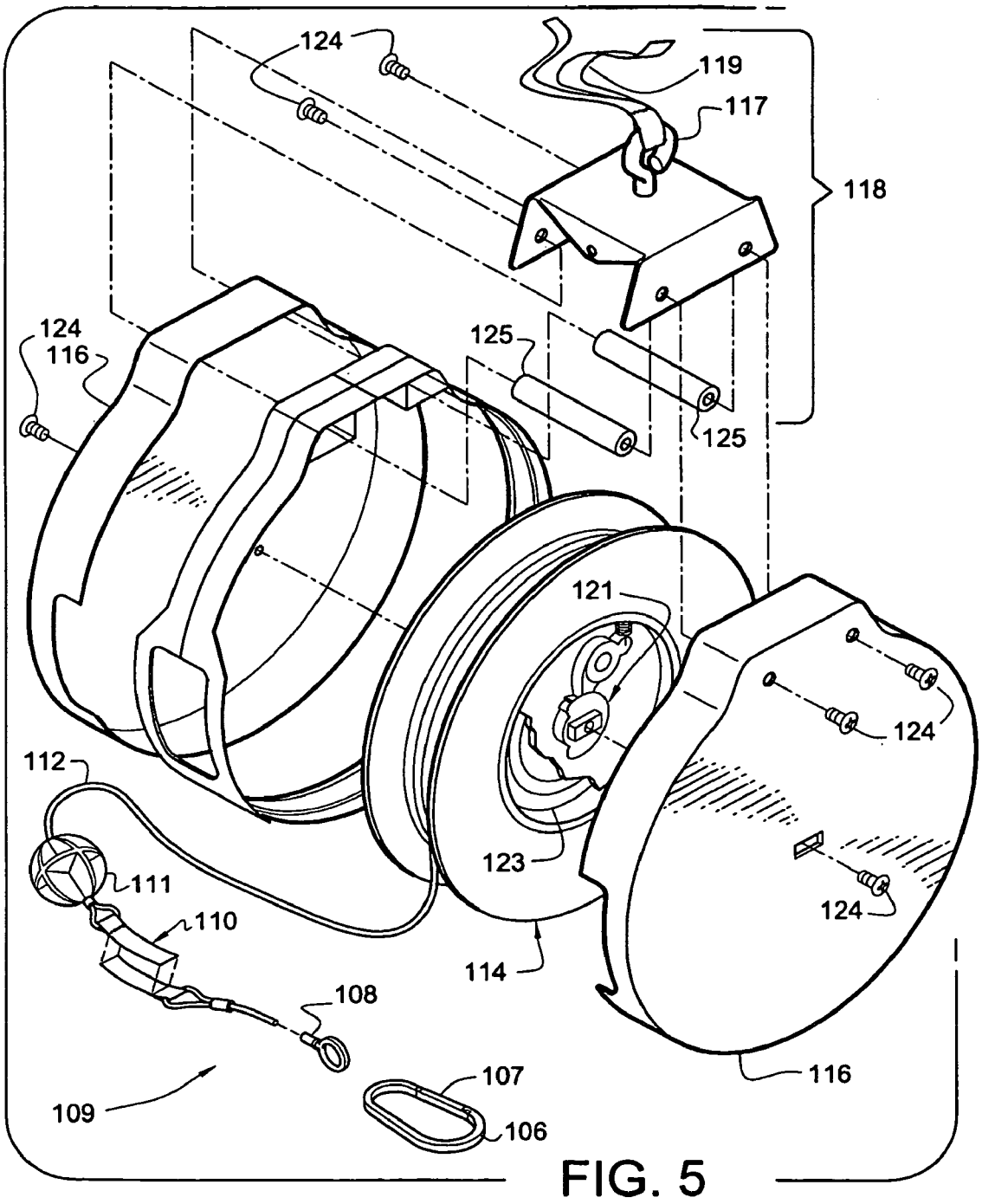
FIG. 5 shows an exploded perspective view of the dally retractor according to FIG. 2.

FIG. 5 shows an exploded perspective view of the dally retractor 109 of FIG. 2. Preferably, case 116 is a circular case, preferably made of a sturdy material, preferably metal, to protect spring 122 and retracted portion of line 112. Upon reading the teachings of this specification, those with ordinary skill in the art will now understand that, under appropriate circumstances, considering such issues as economics, user preference, durability etc., other materials for the case 116, such as plastic, neoprene, PVC, carbon-fiber, etc., may suffice. Furthermore, upon reading the teachings of this specification, those with ordinary skill in the art will now understand that, under appropriate circumstances, considering such issues as economics, user preference, durability, aesthetics, function, etc., other case 116 configurations, such as square, polygonal, etc., may suffice. Preferably, case 116 is held together by screws 124. Preferably, attaching system 118 is connected to case 116 with spacers 125 and screws 124, as shown. Preferably, retractor 109 comprises spring 123 and clutch 121, which are housed inside case 116, as shown. Upon reading this specification, those skilled in the art will now understand that, under appropriate circumstances, considering issues such as cost, consumer demand, etc., other clutch arrangements, such as other types of clutch mechanisms, omitting the clutch, etc., may suffice.

Figure 6:
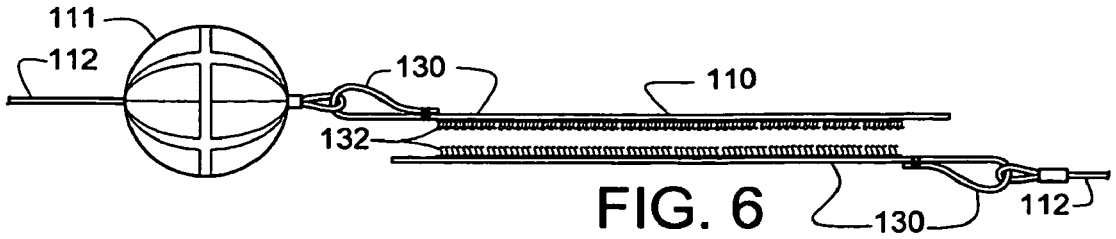
FIG. 6 shows a side view of a safety release mechanism of the dally practicing system according to FIG. 1A.

FIG. 6 shows a side view of a safety release mechanism 110 of dally practicing system 103 according to FIG. 1A. Preferably, safety release 110 comprises two pieces of hook and loop fabric 130 (for example, Velcro™), as shown. Preferably, excessive tension in line 112 acts to pull the two pieces of hook and loop fabric 130 apart, breaking the connection between the hook and loop fabric 130 portions 132. Upon reading this specification, those skilled in the art will now understand that, under appropriate circumstances, considering issues such as the force and operation of retraction mechanism 122, cost, convenience, etc., omitting or having alternative safety release mechanisms, such as for example, a snap that comes undone (thereby disconnecting rope 104 from reel 114) at a predetermined threshold of tension, a clutch that releases at a threshold of tension, etc., may suffice.

FIG. 7 shows a side view, partially in section, of the dally retractor reel 114 according to FIG. 5, illustrating a preferred asymmetric protrusion. Preferably, protrusion 115 causes tension force 109 to be irregular and jerky, much like a fighting steer would be, in order to more closely simulate the dallying experience for training. Upon reading this specification, those of ordinary skill in the art will now understand that, under appropriate circumstances, such as user preference, advances in technology, etc., other sources of random movement, such as other arrangements of protrusions 115, attaching tension force 109 to a mechanical bull, etc., may suffice.

FIG. 8 shows a perspective view of dally retractor reel 114 according to FIG. 7.

Figure 9:
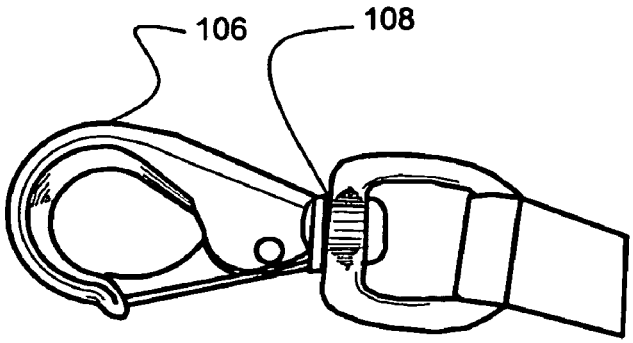
FIG. 9 shows a side view of a swivel and connector for the dally system, according to a preferred embodiment of the present invention.

FIG. 9 shows a side view of a swivel 108 and connector 106 of the dally system 103. Preferably, connector 106 comprises swivel 108, as shown. Preferably, connector 106 and swivel 108 are made of metal, as shown, more preferably steel, for strength and durability. Upon reading this specification, those of ordinary skill in the art will now understand that, under appropriate circumstances, such as user preference, advances in technology, etc., other swivels and connectors, such as plastic swivels, ball-in-socket swivels, plastic connectors, etc., may suffice.

Figure 10:
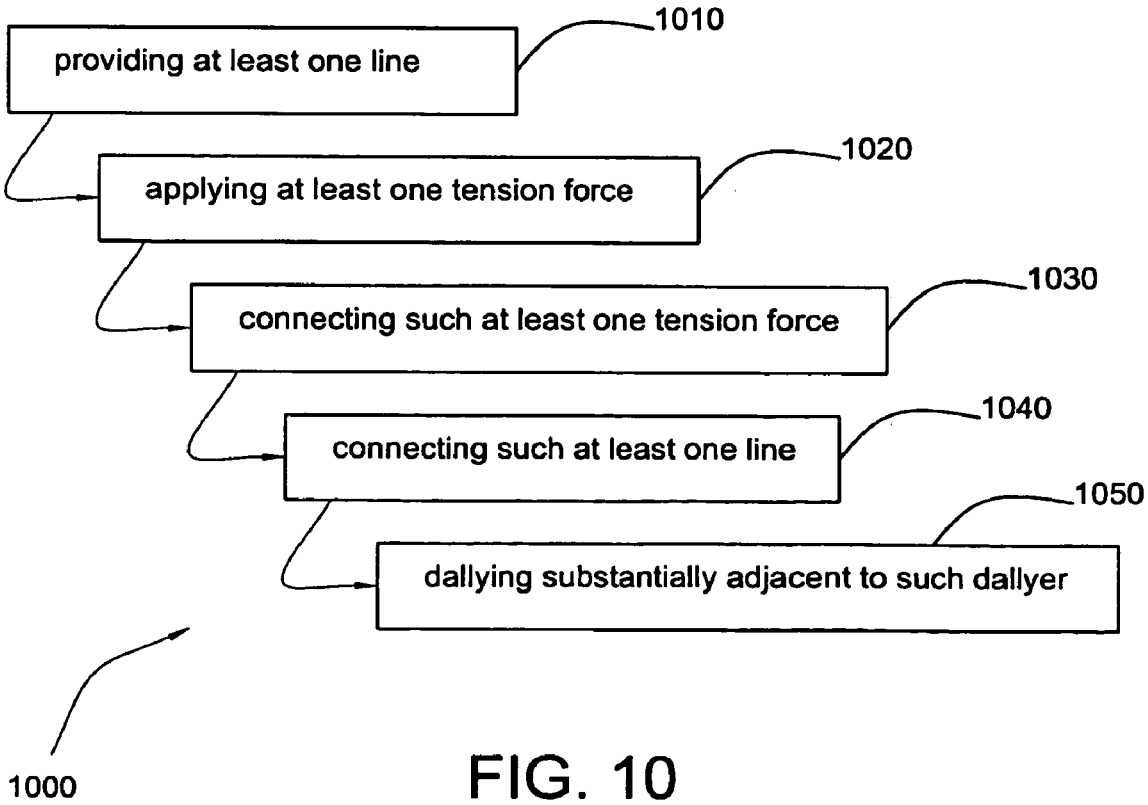
FIG. 10 shows a diagram of a method of safely practicing dallying, according to a preferred embodiment of the present invention.

FIG. 10 shows a diagram of a method 1000 of safely practicing dallying, according to a preferred embodiment of the present invention. Preferably, method 1000 comprises the steps of: providing 1010 at least one line 112; applying 1020 at least one tension force 109 to such at least one line 112 for retracting such at least one line 112; connecting 1030 such at least one tension force 109 to the substantially fixed object 120; connecting 1040 such at least one line 112 to such at least one dallyer's rope 104; and dallying 1050 substantially adjacent to such dallyer 100 when such dallyer 100 is using said at least one line 112 in such dally-practicing (at least embodying herein providing at least one line; applying at least one tension force to such at least one line for retracting such at least one line; connecting such at least one tension force to the substantially fixed object; connecting such at least one line to such at least one dallyer's rope; and dallying substantially adjacent to such dallyer when such dallyer is using said at least one line in such dally-practicing). Upon reading this specification, those of ordinary skill in the art will now understand that, under appropriate circumstances, such as user preference, advances in technology, intended use, etc., other steps, such as adjusting the tension force, timing the dally process, connecting tension force 109 to a movable object, etc., may suffice.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A dally training system, relating to use by a dallyer sitting on a saddle that comprises a saddle born, for safe dally-practicing, near a substantially fixed object, using at least one dally rope positioned in front of the dallyer, said dally training system comprising, in combination:

a) line means for providing at least one selectably retractable line;

b) tension means for controllably applying at least one tension force to said line means for selectably retracting said line means;

c) casing means for encasing said tension means; and d) attachment means for attaching said dally training system to the substantially fixed object;

e) wherein said tension means comprises at least one spring;

f) wherein said line means comprises such at least one dally rope;

g) wherein said at least one dally rope is structured and arranged to permit dallying around the at least one saddle horn by the dallyer sitting on the saddle;

saddle horn means for holding said line means fixable in adjacent position to such dallyer when such dallyer is using said line means in such dally-practicing.

2. The dally training system, according to claim 1, further comprising a) first connection means for connecting said line means to such at least one dally rope;

b) wherein said attachment means comprises swivel means for swiveling.

3. A dally training system, relating to use by a dallier sitting on a saddle that comprises a saddle horn, for safe dally-practicing, near a substantially fixed object, using at least one dally rope positioned in front of the dallyer, comprising, in combination:

a) at least one line structured and arranged to provide at least one selectably retractable line;

b) at least one tensioner structured and arranged to i) controllably apply at least one tension force to said at least one line; and ii) selectably retract said at least one line;

iii) wherein said at least one tensioner comprises at least one reel adapted to wind and unwind said at least one line; and c) at least one attacher adapted to attach said at least one tensioner to the substantially fixed object;

d) wherein said at least one line comprises such at least one dally rope e) wherein said at least one dally rope is structured and arranged to permit dallying around the at least one saddle horn by the dallyer sitting on the saddle;

saddle horn means for holding said line means fixable in adjacent position to such dallyer when such dallyer is using said line means in such dally-practicing.

4. The dally training system, according to claim 3, further comprising a) at least one first connector adapted to connect said at least one line to such at least one dally rope;

b) wherein said at least one attacher comprises at least one swivel.

5. A daily training method, relating to safe daily-practicing, near a substantially fixed object, using at least one dallyer's rope, the dallying steps to be used by a dallyer, comprising, in combination:

a) providing at least one line;

b) providing at least one reel structured and arranged to apply at least one tension force to such at least one line for retracting such at least one line;

c) providing at least one swivel-attachment to attach such at least one reel to the substantially fixed object;

d) connecting such at least one reel to the substantially fixed object;

e) connecting such at least one line to such at least one dallyer's rope; and f) dallying using said at least one dallyer's rope.

6. A dally training system, relating to use by a dallyer, for safe dally-practicing the steps of dallying, near a fixed object, using at least one saddle horn and using at least one dally rope, comprising, in combination:

a) at least one line;

b) at least one reel structured and arranged to apply at least one tension force to said at least one line such that said at least one line is retractable;

c) at least one attacher structured and arranged to attach said at least one reel to the fixed object;

i) wherein said at least one attacher comprises at least one swivel; and d) at least one saddle horn to hold said at least one line substantially adjacent to such dallyer when such dallyer is using said at least one line in such dally-practicing:

e) wherein said at least one line comprises such at least one dally rope f) wherein said at least one dally rope is structured and arranged to permit dallying around the at least one saddle horn.

7. The dally training system, according to claim 6, wherein said at least one dally rope comprises at least one free end which can be coiled in at least one band of the dallyer.

8. The dally training system, according to claim 6, further comprising at least one first connector to connect said at least one line to said at least one dally rope.

9. The dally training system, according to claim 6, wherein said at least one reel comprises at least one asymmetric protrusion adapted to provide irregular retraction of said at least one line.

10. The dally training system, according to claim 6, wherein said at least one tensioner comprises at least one spring.

11. The dally training system, according to claim 6, wherein said at least one tensioner comprises at least one clutch system structured and arranged to allow the dallyer to selectably control tension in said at least one line.

12. The dally training system, according to claim 6, wherein said at least one line comprises at least one safety release.

13. The dally training system, according to claim 12, wherein said at least one safety release comprises at least one hook and loop material.

14. The dally training system, according to claim 6, further comprising at least one anti-kinking element structured and arranged to assist anti-kinking in said at least one line.

15. The dally training system, according to claim 14, wherein said at least one anti-kinking element comprises at least one swivel.

16. A dally training system, relating to use by a dallyer, for safe dally-practicing, near a fixed object, using at least one saddle horn and using at least one dally rope, comprising, in combination:

a) at least one line; and b) at least one tensioner adapted to apply at least one tension force to said at least one line such that said at least one line is retractable;

c) wherein said at least one tensioner comprises at least one reel adapted to wind and unwind said at least one line;

d) wherein said at least one reel comprises at least one eccentric portion adapted to provide irregular retraction of said at least one line;

e) wherein said at least one eccentric portion comprises at least one protrusion;

f) wherein said at least one line comprises at least one dally rope; and g) at least one anti-kinking element structured and arranged to assist anti-kinking in said at least one line.

17. The dally training system, according to claim 16, wherein said at least one eccentric portion comprises exactly one protrusion.

18. The dally training system, according to claim 17, wherein said at least one reel comprises at least one case structured and arranged to house said at least one reel.

19. The dally training system, according to claim 18, wherein said at least one line further comprises at least one stopper structured and arranged to prevent at least one end of said at least one line from being pulled inside of said at least one case.

20. The dally training system, according to claim 16, wherein said at least one anti-kinking element comprises at least one swivel.

21. The dally training system, according to claim 16, wherein said at least one line comprises at least one safety release.

* * * * *

UNITED STATES PATENT AND TRADEMARK OFFICE

CERTIFICATE OF CORRECTION

PATENT NO. : 7,101,186 B1
APPLICATION NO. : 10/813738
DATED : September 5, 2006
INVENTOR(S) : Gabriel T. Hughes It is certified that error appears in the above-identified patent and that said Letters Patent is hereby corrected as shown below:

Column 10, Line 40: Replace “saddle horn means for holding” with --h) saddle horn means for holding--
Column 11, Line 4: Replace “saddle horn means for holding” with --f) saddle horn means for holding--
Column 11, Line 13: Replace “A daily training method” with --A dally training method--
Column 11, Line 13: Replace “to safe daily” with --to safe dally--
Column 11, Line 50: Replace “at least one band of” with --at least one hand of--

Signed and Sealed this

Second Day of January, 2007

JON W. DUDAS
*Director of the United States Patent and Trademark Office*